US008651095B2

(12) United States Patent
Islas

(10) Patent No.: US 8,651,095 B2
(45) Date of Patent: Feb. 18, 2014

(54) BOWSTRING CAM ARRANGEMENT FOR COMPOUND CROSSBOW

(76) Inventor: John J. Islas, Baldwinsville, NY (US)

( * ) Notice: Subject to any disclaimer, the term of this patent is extended or adjusted under 35 U.S.C. 154(b) by 263 days.

(21) Appl. No.: 13/116,731

(22) Filed: May 26, 2011

(65) Prior Publication Data

US 2011/0308508 A1 Dec. 22, 2011

Related U.S. Application Data

(60) Provisional application No. 61/356,109, filed on Jun. 18, 2010.

(51) Int. Cl.
*F41B 5/12* (2006.01)
*F41B 5/14* (2006.01)
*F41B 5/10* (2006.01)

(52) U.S. Cl.
CPC . *F41B 5/123* (2013.01); *F41B 5/10* (2013.01); *Y10S 124/90* (2013.01)
USPC ..... 124/25; 124/25.6; 124/86; 124/900

(58) Field of Classification Search
CPC ..... F41B 5/10; F41B 5/12; F41B 5/14; F41B 5/123
USPC ..... 124/25, 25.6, 86, 900
See application file for complete search history.

(56) References Cited

U.S. PATENT DOCUMENTS 4,169,456 A * 10/1979 Van House ..... 124/61
4,457,288 A * 7/1984 Ricord ..... 124/25.6
4,465,054 A * 8/1984 Nishioka ..... 124/25.6
4,593,674 A * 6/1986 Kudlacek ..... 124/25.6
4,649,890 A * 3/1987 Powers ..... 124/25.6
4,649,891 A * 3/1987 Bozek ..... 124/25
4,667,649 A * 5/1987 Humphrey ..... 124/25.6
4,683,865 A * 8/1987 Troncoso ..... 124/25.6
4,757,799 A * 7/1988 Bozek ..... 124/25.6
4,781,168 A * 11/1988 Lester ..... 124/25.6
4,917,071 A * 4/1990 Bozek ..... 124/25
5,388,564 A * 2/1995 Islas ..... 124/25.6
5,678,528 A * 10/1997 Hadley ..... 124/25
6,067,974 A * 5/2000 Islas ..... 124/25.6
6,082,346 A * 7/2000 Andrews et al. ..... 124/25.6
6,098,607 A * 8/2000 Strother ..... 124/25.6
6,470,870 B1 * 10/2002 Schaar ..... 124/25.6
6,474,324 B1 * 11/2002 Despart et al. ..... 124/25.6
6,776,148 B1 * 8/2004 Islas ..... 124/25.6
6,792,931 B1 * 9/2004 Schaar ..... 124/25.6
7,578,289 B2 * 8/2009 Norkus ..... 124/25.6

(Continued)

*Primary Examiner* — Gene Kim
*Assistant Examiner* — Alexander Niconovich
(74) *Attorney, Agent, or Firm* — Bernhard P. Molldrem, Jr.

(57) ABSTRACT

A compound bow or crossbow employs bowstring cams with bowstring cam grooves and power cord cam grooves. Preferably a pair of generally identical power cord cam grooves are positioned axially above and below the bowstring cam groove. The power cords are anchored to a fixed anchor point, e.g., a pylon, on the near end of the riser or on the near side of the crossbow bar or stock. The power cords do not cross over to the other limb. The reduction in the number of cam wheels and pulleys and in the number of strings or cords results in greater efficiency and higher transfer of energy from the bow to the arrow or bolt. There is no drop-off in pull weight at full draw. The bolt or arrow accelerates throughout the travel of the bowstring, resulting in significantly higher velocity.

4 Claims, 3 Drawing Sheets

(56) References Cited

U.S. PATENT DOCUMENTS

| | | | | |
|---|---|---|---|---|
| 7,637,256 | B2 * | 12/2009 | Lee | 124/25.6 |
| 7,823,572 | B2 * | 11/2010 | Anderson | 124/25 |
| 7,891,348 | B2 * | 2/2011 | Colley | 124/25 |
| 8,037,876 | B1 * | 10/2011 | Yehle | 124/25.6 |
| 8,387,603 | B2 * | 3/2013 | Darlington | 124/25.6 |
| 2006/0169260 | A1 * | 8/2006 | Chang | 124/25.6 |
| 2008/0127956 | A1 * | 6/2008 | Bednar et al. | 124/25 |
| 2008/0251058 | A1 * | 10/2008 | Colley | 124/25 |
| 2011/0041820 | A1 * | 2/2011 | Stanziale | 124/25 |

* cited by examiner

BOWSTRING CAM ARRANGEMENT FOR COMPOUND CROSSBOW

Applicant claims priority under 35 U.S.C. §119(e) of Provisional Application Ser. No. 61/356,109, filed Jun. 18, 2010.

BACKGROUND OF THE INVENTION

This invention is directed to the field of archery, and more specifically to compound bows of the type employing cams and control cables to achieve a programmed draw weight, and the latter being variable with draw length. Applicant incorporates by reference prior U.S. Pat. No. 6,776,148 and other patents referred to in that document, that is, archery bows that have cams and power cords, and are programmed for optimal draw weight characteristics.

Typically, compound bows have means to regulate their draw weight so that a maximum pull weight is attained at an intermediate draw position, and with the draw weight dropping to some fraction of maximum pull weight at the full draw position.

It is also an objective of modern bows and crossbows to transfer to the bolt or arrow as much as possible of the energy that is stored in the bow, so that the projectile will fly faster and farther for a given draw weight. These goals have been difficult to achieve. Some inefficiencies are due to mechanical losses in the crossover strings and pulley mechanisms.

Unlike the prior designs, the present invention does not obtain the maximum draw weight at a partial draw position and then drop off draw weight at the full draw position. Instead, the bow or crossbow is designed so that draw weight increases continuously to full draw. This characteristic is required in some forms of long bow archery, and is useful in crossbow archery, because the crossbow has a mechanical release that holds the bowstring at full draw. Because the crossbow does not have to allow for drop-off of pull weight, there is no need for synchronizing cords or strings, and no need for cross-over strings.

OBJECTS AND SUMMARY OF THE INVENTION

Accordingly, compound bow or crossbow of this invention employs bowstring cams with bowstring cam grooves and power cord cam grooves (either a single power cord cam groove or more preferably a pair of generally identical power cord cam grooves positioned axially above and below the bowstring cam groove). The power cords are anchored to a fixed anchor point, e.g., a pylon, on the near end of the riser or on the near side of the crossbow bar or stock. The power cords do not cross over to the other limb. The reduction in the number of cam wheels and pulleys and in the number of strings or cords results in greater efficiency (due to smaller mechanical losses) and higher transfer of energy from the bow to the arrow or bolt. The bolt or arrow accelerates throughout the travel of the bowstring, resulting in significantly higher velocity.

DETAILED DESCRIPTION OF A PREFERRED EMBODIMENT

Figure 1:
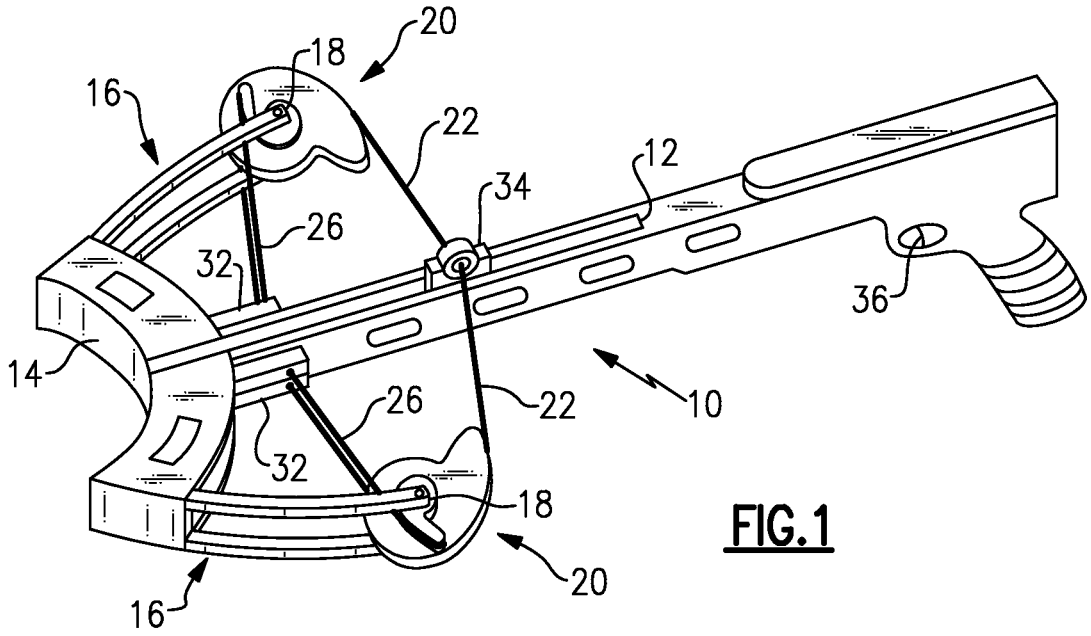
FIG. 1 is a perspective view of a crossbow embodying this invention.

The invention is explained in terms of a possible preferred embodiment, here a crossbow 10, in which there is an axial beam or stock 12 defining a medial plane with a riser 14 extending transversely at a front or distal end thereof. At each end of the riser 14 there is a power limb or spring limb 16, i.e., a spring limb at the right end of the riser and one at the left end. Each spring limb 16 has one end anchored to the riser and at its other end a pivot 18 in which a respective cam wheel 20 is supported. In this embodiment, the spring limbs 16 are formed of an upper portion and a lower portion, with the cam wheel 20 held in between them.

Note that in a crossbow, the riser extends horizontally or transversely, while in a long bow the riser extends vertically. The mechanics of operation are the same in either orientation.

Figure 4:
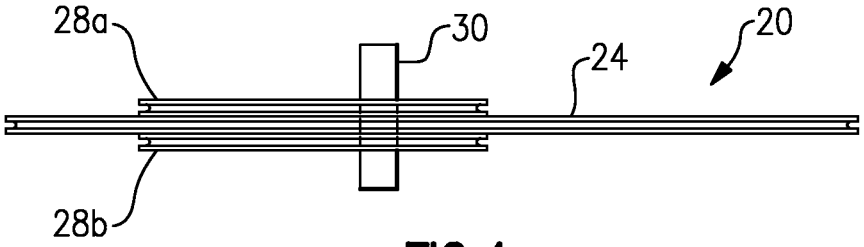
FIG. 4 is an edge-on view of the bowstring cam thereof.
Figure 2:
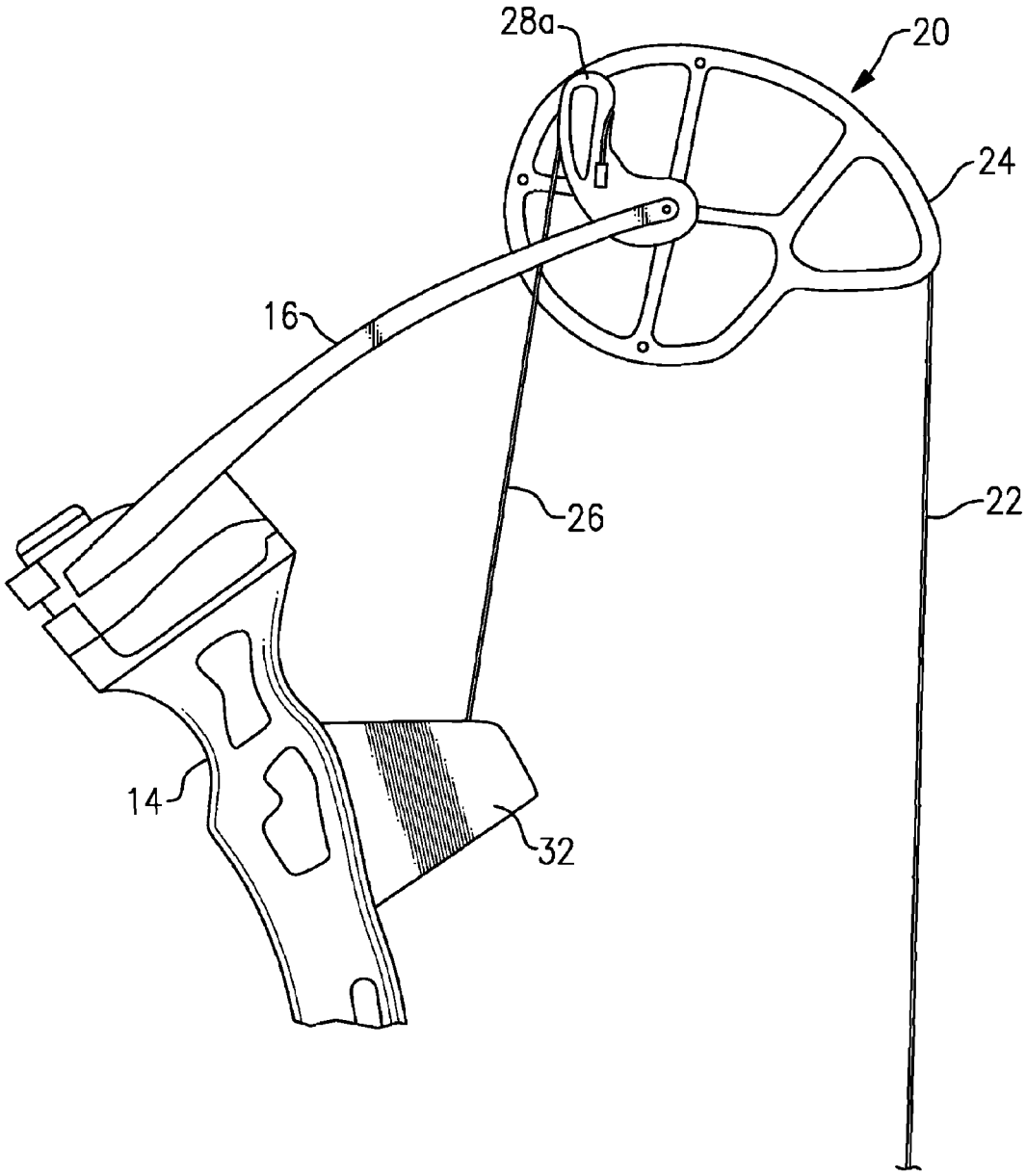
FIG. 2 is an plan view of the right limb thereof (the left limb being generally a mirror image of the right limb).
Figure 3:
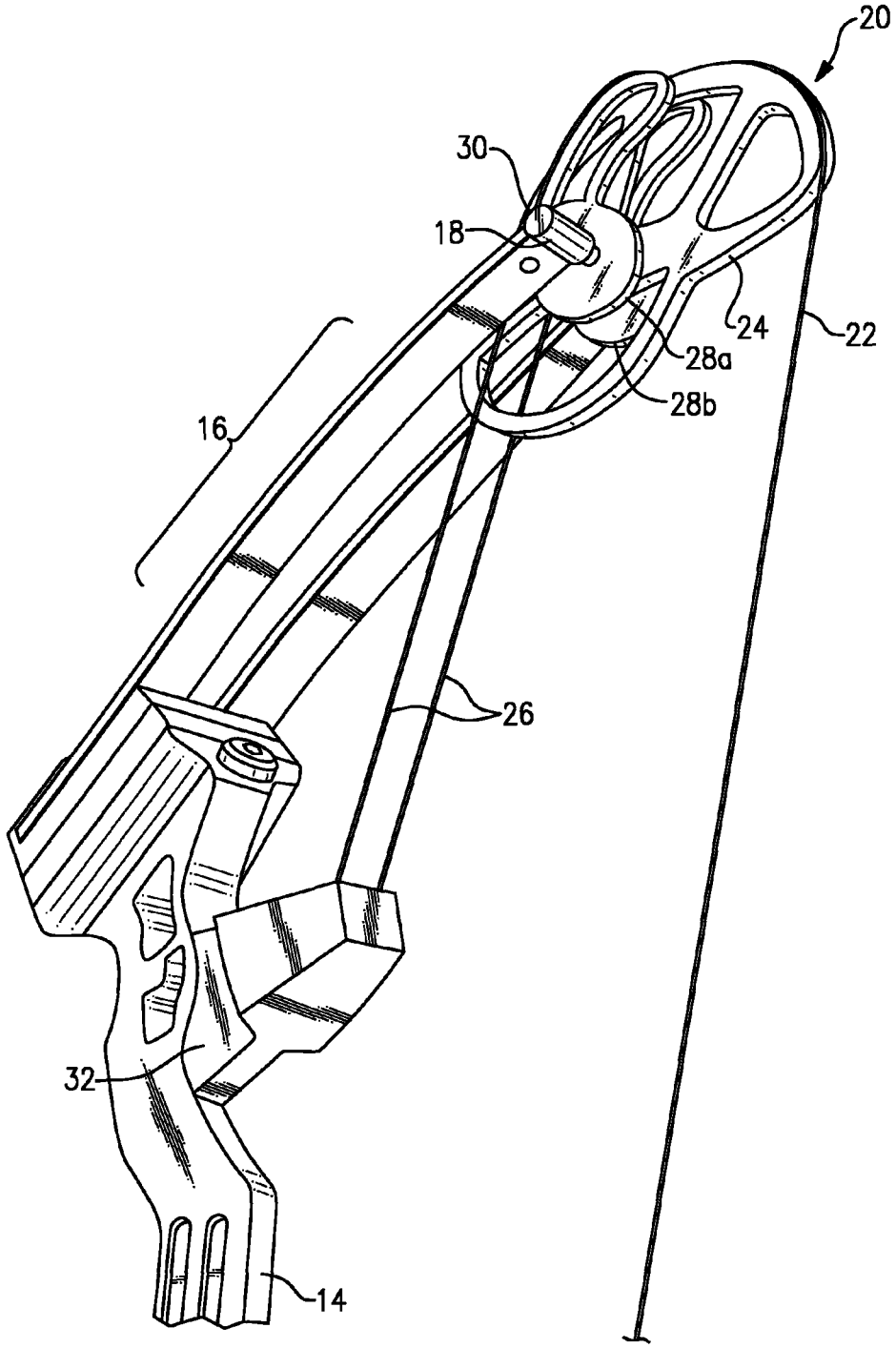
FIG. 3 is a perspective view thereof.

A bow string 22 is attached to each bowstring cam 20 and rides in a peripheral bowstring groove or channel 24 in each of these cams. In this invention there are no synchronizing pulleys nor any crossover cables. At each limb there are a pair of power cables 26 are reeved to respective power cable cam grooves 28*a* and 28*b* that are coaxial with the associated bowstring cam groove 24, and are situated axially above and below the same. These cam grooves 24, 28*a* and 28*b* are shown in relation to the axle 30 of the cam wheel 20 (See FIG. 4) The other ends of the power cables 26 are affixed at anchor points, here in the form of rigid pylons 32 affixed onto the riser, and projecting proximally (toward the archer position or handle end of the crossbow). In other possible embodiments, the anchor points may be on the beam or stock 12. Importantly, the power cords 26 do not cross the medial plane of the bolt or arrow, and do not travel against one another nor travel on or against any mechanical parts such as pulleys.

Also shown here is a traveling string release 34 mounted on a track on the top of the beam 12. This release can closed over the bow string and then cranked back to a full draw position by means of a screw or pulley mechanism (not shown). Many other cocking devices are possible. Also a finger trigger mechanism 36 is shown at a handle end of the stock.

While the invention has been described and illustrated in respect to a selected preferred embodiment, it should be appreciated that the invention is not limited only to that precise embodiment. Rather, many modifications and variations would present themselves to those of skill in the art without departing from the scope and spirit of this invention, as defined in the appended claims.

I claim:

1. A crossbow comprising a stock situated at a medial plane of the crossbow, a transverse riser at a distal end of the stock, pair of power limbs or spring limbs disposed one at each end of the riser, each of said power limbs or spring limbs being formed as a flexible resilient bar spring to supply motive force for an arrow or bolt to be fired from said crossbow, and each said power limb or spring limb having one free end and another end that is affixed to the respective end of the riser, the spring limbs each projecting from said riser to said free end; cam wheels each pivotally mounted at a pivot at the free end of each of the associated power limbs; the cam wheels each having a bowstring groove wherein a bowstring is reeved to each of the cam wheels and travels in the respective bowstring grooves to be wound and unwound therefrom, and upper and lower power cord cam grooves disposed axially above and below the associated bowstring groove of the cam wheel; power cords which are flexible and inextensible and are wound into the power cord cam grooves; and anchor members affixed to the respective side of the medial plane corresponding to the crossbow bolt axis and defining fixed anchor points in respect to said stock; wherein the power cords are affixed at ends remote from the cam wheel into the respective anchor member at the associated anchor point, such that none of the power cords extend across the medial plane to the other limb; and wherein the power cord cam grooves and the bowstring cam grooves are programmed such that the draw weight on the bow string increases from full brace position to full draw position without weight drop-off.

2. The crossbow according to claim 1, wherein said anchor members comprise rigid pylons affixed onto said riser.

3. The crossbow according to claim 1, wherein said anchor members comprise rigid pylons affixed onto said stock.

4. The crossbow according to claim 1, wherein said riser is disposed transversely at the distal end of said stock to extend laterally to each side of the stock.

* * * * *